US006296574B1

(12) United States Patent
Kaldis

(10) Patent No.: US 6,296,574 B1
(45) Date of Patent: Oct. 2, 2001

(54) GOLF SWING IMPROVEMENT DEVICE

(76) Inventor: Alexis G. Kaldis, 200 Pelican Ct., Foster City, CA (US) 94404

( * ) Notice: Subject to any disclaimer, the term of this patent is extended or adjusted under 35 U.S.C. 154(b) by 0 days.

(21) Appl. No.: 09/264,301

(22) Filed: Mar. 8, 1999

(51) Int. Cl.[7] ..... A63B 53/06; A63B 53/16; A63B 69/36

(52) U.S. Cl. ..... 473/236; 473/220; 473/223; 473/229; 473/236; 473/307; 473/313; 473/325; 473/329; 473/335; 473/342; 473/346

(58) Field of Search ..... 473/220, 223, 473/229, 307, 313, 325, 329, 335, 342, 346, 236

(56) References Cited

U.S. PATENT DOCUMENTS

| | | | |
|---|---|---|---|
| 976,176 | 11/1910 | Hollingsworth . | |
| 3,194,564 | 7/1965 | Swan | 273/186 |
| 3,384,376 | 5/1968 | Greenlee | 273/164 |
| 3,730,529 | 5/1973 | Donofrio | 273/186 A |
| 4,988,107 | 1/1991 | Sasse | 273/183 |
| 5,135,229 | 8/1992 | Archer | 273/186.2 |
| 5,219,169 | 6/1993 | Martini | 273/162 B |
| 5,417,429 | 5/1995 | Strand | 273/187.4 |
| 5,429,366 | 7/1995 | McCabe | 273/187.4 |
| 5,441,273 | 8/1995 | Stormon | 273/187.4 |
| 5,447,313 | 9/1995 | Finley | 273/187.4 |
| 5,709,611 | 1/1998 | Intag | 473/236 |

*Primary Examiner*—Lee Young
*Assistant Examiner*—Paul Kim

(57) ABSTRACT

An apparatus allows a golfer to improve his or her swing. A striking pin is mounted on a club head using a rigid bracket. The golfer swings so as to strike a golf ball with an end surface of the striking pin. Progressively smaller striking pin end surface areas may be used. After practicing using the striking pin, a golfer removes the striking pin and continues with normal play.

13 Claims, 4 Drawing Sheets

GOLF SWING IMPROVEMENT DEVICE

FIELD OF INVENTION

The invention relates to the sport of golf and, in particular, to an apparatus and method for improving a player's golf swing during putting.

BACKGROUND

In order to putt effectively, a golf player must have fine control over where the putter strikes the ball and the initial direction of the putted ball. During a putting stroke, the energy imparted to the ball, affecting its initial speed, will be greater when the ball is struck with the putter's "sweet spot." Striking the ball on the sweet spot imparts minimal torque on the putter, thus transferring more predictable energy to the ball. Additionally, it is important that the putter face be perpendicular to the putter's motion so that the ball's initial direction will be in the direction of the putting stroke. Many of these considerations apply to play with other lofted clubs.

What is needed, therefore, is a device to assist a golf player to learn how to focus on the desired impact point on a golf ball and strike the ball correctly during the putting stroke.

SUMMARY

In accordance with one embodiment of the invention, one of a striking pin is mounted on a mounting bracket. The opposite end of the striking pin has a flat striking surface. The mounting bracket holding the striking pin is configured to be rigidly yet removably attached to a golf club head without physically altering the club head. The bracket is further configured to allow the striking pin's striking surface to be parallel with the club head face. In other embodiments, the striking surface angle may be different.

In one embodiment, a golfer attaches the mounting bracket with striking pin to a putter such that the striking surface of the pin is located at the putter's sweet spot. The golfer then swings the putter so that the striking pin's small striking surface hits a target golf ball at a desired impact point. Any faulty swing will result in the ball angling off from a hit on an edge of the striking pin rather than from a hit on its striking surface. In effect, the striking pin has reduced the putter's sweet spot to the size of the pin's striking surface. Similarly, any skewing of the club face angle will cause the pin's striking surface to be offset from the ball, causing the ball to be deflected at a wide angle.

When the golfer achieves proficiency using the striking pin, he or she removes the mounting bracket and pin and continues regular play with the club, having learned increased directional and alignment control during his or her swing. As a further refinement of a training method, a golfer may sequentially use an additional one or more striking pins, each pin having a progressively smaller striking surface area. The reduced striking surface area of the additional pins forces the golfer to make additional adjustments to his or her swing. When proficient, the golfer then removes the additional striking pin and engages in regular play.

The mounting bracket may be attached to the club head in various ways. In some embodiments the bracket is affixed to the club head using a set screw. In some embodiments, a spring is used to clamp the bracket to the club head. In still other embodiments, the bracket is held to the club head using elastic devices. Other mounting methods are possible. Means for mounting the bracket to the club head may include padding so as to avoid scratching the club head.

In some embodiments the striking pin is made removable from the bracket. In embodiments in which the striking pin is removable, one or more additional striking pins may then be attached to the bracket. An additional striking pin has a smaller striking surface area than the original pin's striking surface area.

DETAILED DESCRIPTION

As shown in the accompanying drawings, elements having the same number in different figures are intended to represent similar elements. Embodiments shown and described are for clubs used by right-handed golfers. Those skilled in the art should understand that embodiments of the invention apply equally to clubs used by left-handed golfers. While embodiments of the invention are discussed with respect to putters, the invention may be used with golf clubs other than putters. The figures show a conventional "bull's-eye" style EL DORADO putter produced by R.A.C.O., but embodiments of the invention may be used with, or modified to fit, many club head styles.

Figure 1:
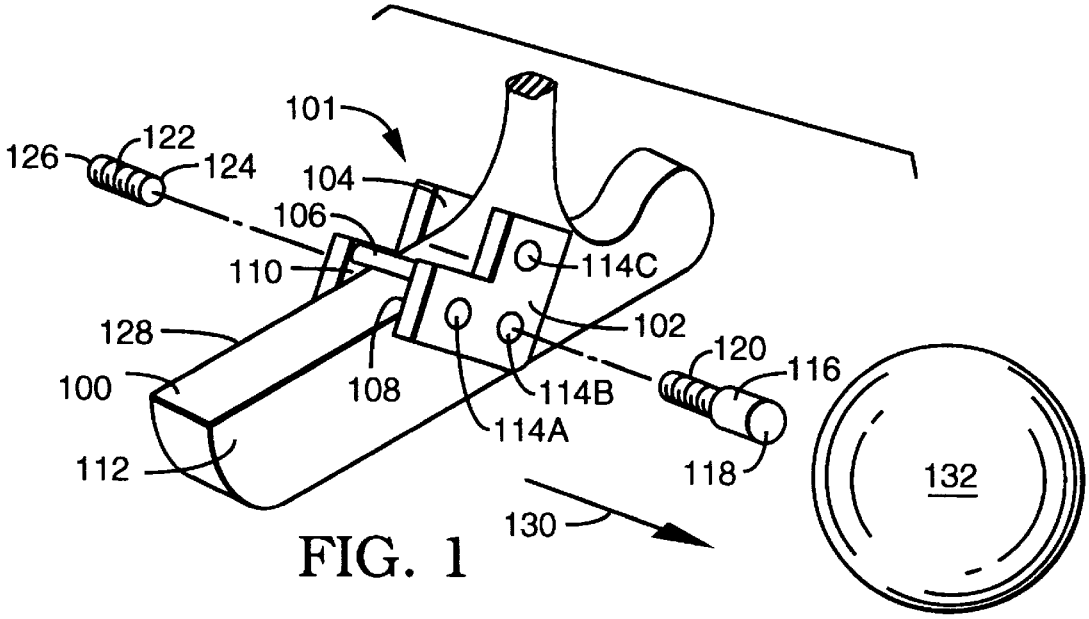
FIG. 1 is an exploded perspective view of an embodiment of the invention.

FIG. 1 is an exploded perspective view of an embodiment of the invention positioned on a putter 100. Although shown in one position, bracket 101 may be reversed as a user desires. A bracket 101 is shown having a front bracket 102 and a rear bracket 104. Front bracket 102 is connected to rear bracket 104 using rigid cross member 106. The bracket 101 may be an integral unit or may be formed of pieces. In one embodiment, bracket 101 is machined from a single aluminum block.

Front bracket 102 has an inner face 108, and rear bracket 104 has an inner face 110. Inner faces 108 and 110 are opposite each other and are spaced apart so as to allow putter 100 to slide between front bracket 102 and rear bracket 104. When bracket 101 is properly mounted on putter 100, a portion of inner face 108 will be flush with putter face 112. Front bracket 102 has three holes 114A, 114B, and 114C. Each hole is threaded with an identical thread pitch to receive a screw. Rear bracket 104 also has three holes (not shown) in a similar pattern and having the same thread pitch as the threads in holes 114A–C.

A striking pin 116 is shown having a striking surface 118 and a threaded end 120. The diameter and thread pitch of threaded end 120 are selected so as to allow striking pin 116 to be inserted into and rigidly held in any of holes 114A–C, or similar holes in rear bracket 104. In some embodiments, striking pin 116 and a mounting bracket may be an integral piece.

A set screw 122 is shown with a diameter and thread pitch allowing insertion into holes 114A–C or similar holes in rear bracket 104. When bracket 101 is mounted on putter 100, set screw 122 is tightened so that set screw end 124 is tight against putter rear surface 128. In the embodiment shown, set screw 122 is tightened using a hex key wrench inserted in end 126. In other embodiments, more than one set screw may be used.

During use, striking pin 116 is inserted into a hole 114A–C, and bracket 101 is securely attached to putter 100 by tightening set screw 122. Bracket 101 is positioned such that striking pin 116 is aligned with the desired striking point on putter face 112 (many putters indicate a proper striking point by using a scribe line or similar mark on a top surface). A player swings the putter in the direction shown by arrow 130 so that striking surface 118 impacts a target golf ball 132. If the player swings so that striking surface 118 hits the golf ball correctly, as described above, the ball will move in the desired direction. If the player swings incorrectly, however, the small size of striking surface 118 will cause the ball to move in other than the desired direction, thus providing immediate feedback to the player that his or her swing was incorrect. In this way, a player may quickly learn how to properly swing the putter. A player retains this skill when he or she removes the invention from putter 100 and engages in normal play.

Embodiments of this invention allow a player to use more than one diameter of striking pin 116. A player may first practice with a relatively large diameter striking pin 116. Once a player reaches satisfactory performance with a large diameter striking pin, he or she may remove the larger striking pin and insert a smaller diameter striking pin. The smaller striking surface area on the small diameter pin once again forces the player to refine his or her stroke. In this way, a player may achieve greater putting proficiency by progressively using striking pins having smaller and smaller striking surface areas.

Increasing the length of the striking pin will require a more precise angle of the putter face with respect to the intended impact point of the ball for a proper putt.

Figure 2:
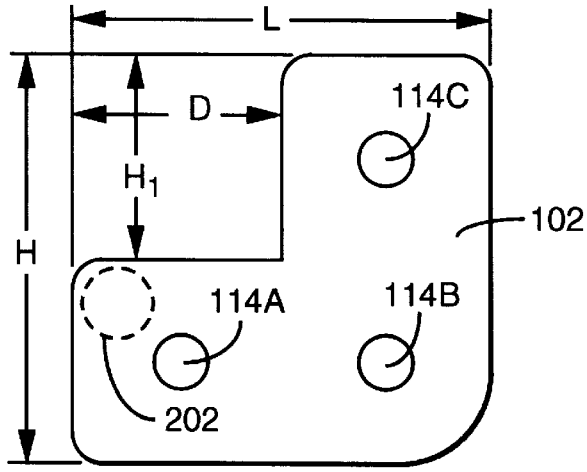
FIG. 2 is a side view of an embodiment of the invention.

Embodiments of the invention will now be described in greater detail. FIG. 2 is a side view of an embodiment of the invention showing front bracket 102 of bracket 101. In one embodiment, bracket 101 is fabricated from one-quarter inch (¼ in.) thick aluminum. Aluminum is chosen because it has sufficient strength to support a striking pin during repeated golf ball impacts, yet aluminum is also light weight, so that a player may use an embodiment of the invention without significantly affecting the weight and feel of the club to be used in regular play. Other embodiments may use other strong and light weight materials such as other metals or rigid plastic. Some embodiments may combine materials. For example, cross member 106 (hidden, shown by dashed line 202) may be made of a stronger metal such as steel to withstand the bending force when bracket 101 is mounted on a putter.

As shown, front bracket 102 is an approximate "L" shape having height H, length D, cutout height $H_1$, and cutout depth D. In the embodiment shown, height H and length L are each approximately one and one-quarter inch (1¼ in.), and height $H_1$ and depth D are each approximately five-eighths inch (⅝ in.). In other embodiments, however, front bracket 102 may be formed in other shapes such as a rectangle, an ellipse, or other geometric shape. It is important that front bracket 102 be sized so as to allow mounting on a club head but not to extend significantly below the bottom of the club head, thus allowing a player to swing using an embodiment of the invention in the same way as during regular play.

Three holes 114A, 114B, and 114C are shown in front bracket 102. Other embodiments may have more or fewer holes. The holes are configured to receive a striking pin, which is discussed in more detail below. For example, the inside surfaces of one or more holes may be threaded, or may be scribed to hold a snap ball fitting similar to fittings commonly used on socket wrenches. In one embodiment, the holes are threaded to receive both a striking pin and a set screw, thereby allowing bracket 101 to be reversed when mounted on a putter. Set screws are described in more detail below. In embodiments using other than threading, holes 114A–C may have a square or other shape as required for the mounting system used.

Figure 3:
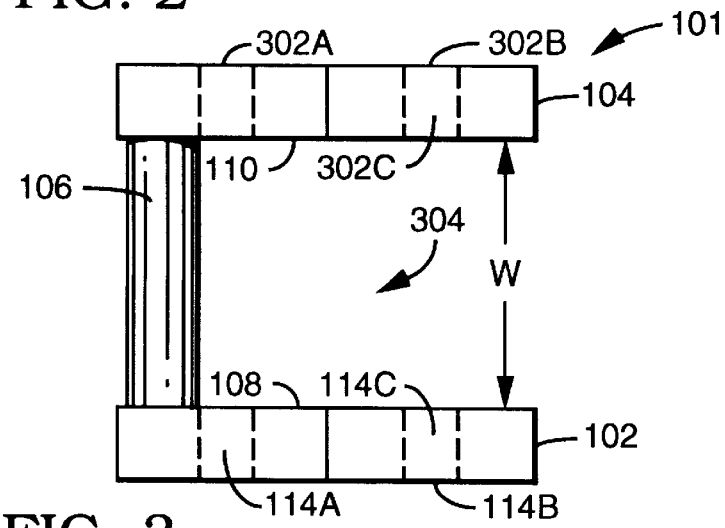
FIG. 3 is a top view of an embodiment of the invention.

FIG. 3 is a top view of an embodiment of the invention. Cross member 106 is shown connecting front bracket 102 and rear bracket 104. In one embodiment, cross member 106 is made of aluminum and is attached to front bracket 102 and rear bracket 104 by using conventional welding techniques. In another embodiment, front bracket 102, rear bracket 104, and cross member 106 are machined from a single piece of aluminum or other lightweight and strong material such as plastic. In other embodiments, cross member 106 may be attached between front bracket 102 and rear bracket 104 with any suitable method strong enough to withstand the clamping force generated when a set screw is tightened on a club head.

FIG. 3 also shows holes 302A, 302B (hidden), and 302C in rear bracket 104 positioned similarly to holes 114A–C in front bracket 102. Some embodiments may have more or fewer than three holes in rear bracket 104. As discussed above, in one embodiment holes 302A–C are of the same diameter and thread pitch as holes 114A–C so as to allow either a set screw or striking pin to be inserted into both front bracket 102 and rear bracket 104.

Front bracket 102 and rear bracket 104 are separated by a width W sufficient to allow a club face to slide into channel 304. In one embodiment, width W is three-quarter inch (¾). In other embodiments, width W may be varied to allow the bracket to be mounted on particular club heads. As shown, inner face 108 and inner face 110 are bare. In some embodiments, however, either or both inner face 108 and inner face 110 may have a padding to prevent scratching a club head when bracket 101 is mounted.

Figure 4:
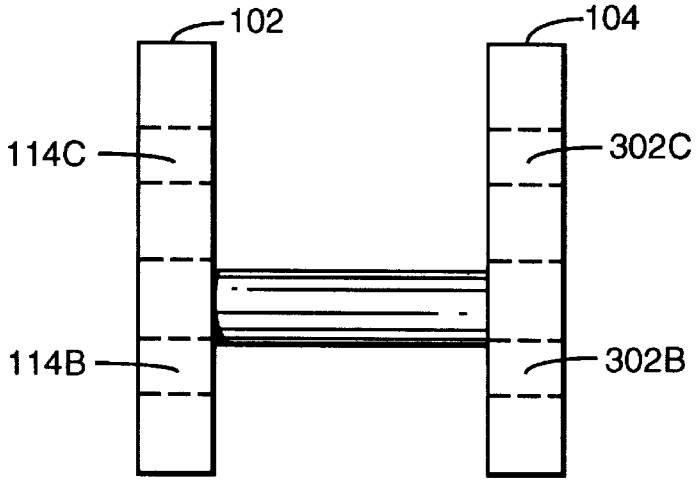
FIG. 4 is an end view of an embodiment of the invention.

FIG. 4 is an end view of an embodiment of the invention showing an additional perspective. As shown, holes 302B and 302C in rear bracket 104 are opposite holes 114B and 114C in front bracket 102, respectively. In other embodiments, holes may be placed in a different pattern.

Figure 5A:
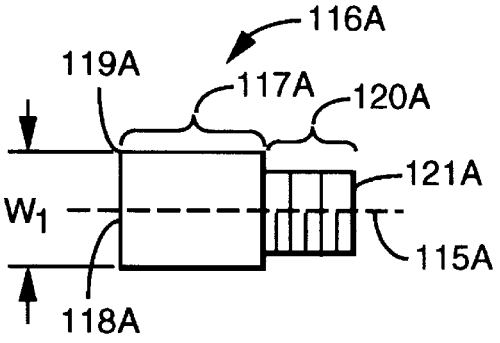
FIGS. 5A and 5B are side views of striking pins used in embodiments of the invention.

FIG. 5A is a side view showing an embodiment of a striking pin. Striking pin 116A has a striking surface 118A, an end 121A, and an axis 115A between striking surface 118A and end 121A. Axis 115A is essentially perpendicular to the plane of striking surface 118A. In some embodiments, striking surface 118A may be other than perpendicular to axis 115A. As shown, striking pin 116A has a first width $W_1$ and a threaded end 120A.

Figure 5B:
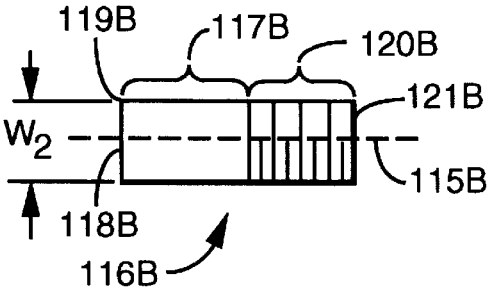

FIG. 5B is a side view showing another embodiment of a striking pin 116B. Striking pin 116B has a striking surface 118B, an end 121B, and an axis 115B between striking surface 118B and end 121B. As depicted, axis 115B is essentially perpendicular to the plane of striking surface 118B, but other surface angles are possible. As shown, striking pin 116B has a second width $W_2$ and a threaded end 120B.

For the embodiments shown in FIGS. 5A and 5B, width $W_1$ is greater than width $W_2$. In one embodiment width $W_1$ is three-eighths inch (⅜ in.) and W2 is one-quarter inch (¼ in.). Other widths may be used. In one embodiment, pin portions 117A and 117B are approximately three-eighths inch (⅜ in.) long. In another embodiment, pin portion 117B is approximately one-half inch (½ inch) long to require a more precise club face angle with respect to the ball. Lengths of other embodiments of striking pins may vary, as long as the length does not significantly affect the normal golf swing.

In one embodiment of the invention, striking surfaces 118A and 118B are circular. In other embodiments, striking surfaces 118A and 118B may have an alternate shape such as square or other multi-sided geometric shape. As shown, pin portions 117A and 117B are smooth. In other embodiments, pin portions 117A and 117B may be roughened so as to provide an easier grip when inserting and removing the pins by hand. Roughening may include knurling, or ridges extending from a multi-sided geometric shape used as striking surface 118A or 118B. In some embodiments, edges 119A and 119B may be beveled or rounded to avoid cutting the surface of a target golf ball during striking.

As depicted in FIGS. 5A and 5B, threaded ends 120A and 120B have the same diameter and thread pitch, thus allowing a player to remove pin 116A and replace it with pin 116B in order to implement an embodiment of the training method discussed above. In other embodiments, threaded ends 120A and 120B may be replaced by any other suitable mounting means such as snap ball, push-in and lock twist, or other methods of rigidly securing a removable pin well known in the mechanical arts. In one embodiment, striking pins 116A and 116B are made of steel. In other embodiments, any suitably hard material may be used so long as the material withstands repeated impacts against golf balls.

Figure 6A:
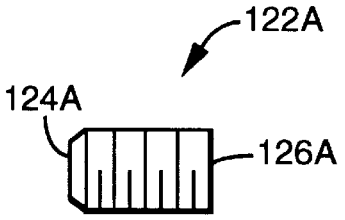
FIGS. 6A and 6B are side views of securing screws used in embodiments of the invention.

FIG. 6A is a side view showing a set screw 122A used in an embodiment of the invention. As described above, in some embodiments set screw 122A has a diameter and thread pitch equal to the diameter and thread pitch of a striking pin (threaded portion 120A of pin 116A in FIG. 5A, for example). In embodiments in which striking pin 116A uses a different mounting method, as described above, set screw 122A may still be threaded for insertion into a hole 302B in rear bracket 104 (FIG. 4), for example. In some embodiments set screw end 124A may be covered with a soft material so that set screw 116A does not scratch a club head when an embodiment of the invention is securely mounted on the club head. As described above, set screw end 126A is configured to receive a hex wrench to allow set screw 122A to be tightened or loosened. Other embodiments of set screw end 126A may use other configurations for receiving a tool used to tighten a screw.

Figure 6B:
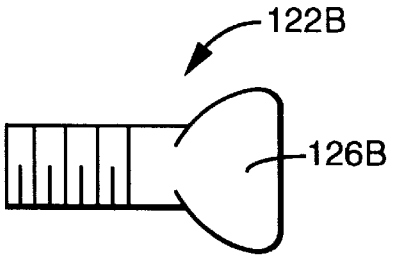

FIG. 6B shows another embodiment of a set screw 122B. Set screw end 126B is shown extended and flattened to allow turning using the fingers. In still other embodiments, end 126B may be any conventional shape to assist finger turning as known in the art.

Figure 7:
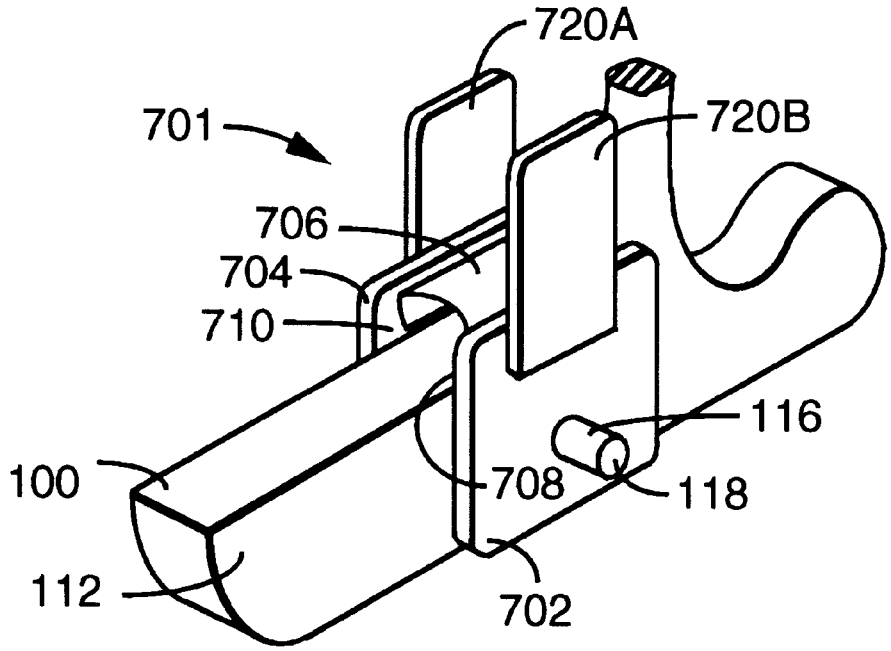
FIG. 7 is a perspective view of a second embodiment of the invention.

FIG. 7 is a perspective view of a second embodiment of the present invention. A mounting bracket 701 is shown comprising front bracket 702, rear bracket 704 and resilient spring 706. Spring 706 provides a gripping force between inner surface 708 of front bracket 702 and inner surface 710 of rear bracket 704. Thus, mounting bracket 701 is a spring clamp attached to club head 100 so as to hold striking pin 116 in place. Mounting bracket 701 holds striking pin 116 so that striking surface 118 is essentially parallel to front face 112 of club head 100. In the embodiment shown, finger tabs 720A and 720B are provided to aid mounting bracket 701 mounting and removal. Other embodiments may use finger tabs having a different shape, or may omit finger tabs altogether. As discussed above, striking pin 116 may be made removable so that striking pins having different size striking surfaces 118 may be used in accordance with the training method discussed above. One advantage of the embodiment shown in FIG. 7, and of similar embodiments, is that it allows quick mounting and removal for club head 100.

Figure 8:
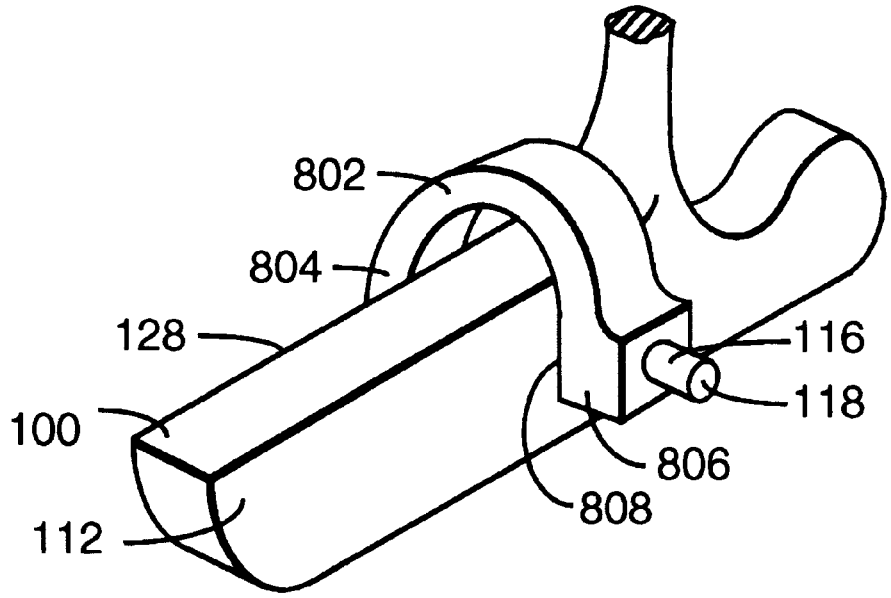
FIG. 8 is a perspective view of a third embodiment of the invention.

FIG. 8 is a perspective view of a third embodiment of the invention. A rigid bracket 802 having a rear element 804 and a front element 806 is shown mounted over club head 100 and supporting striking pin 116. As shown, an inner surface 808 is essentially flush against front face 112 of club head 100. Bracket 802 may be secured to club head 100 by using a set screw (not shown), as described in detail above, in rear element 804 tightened against rear surface 128 of club head 100. In other embodiments, a threaded portion of striking pin 116 may be elongated so that the threaded portion extends through front element 806 so as to be tightened against front face 112. As discussed above, striking pin 116 may be made removable so that striking pins having different size striking surfaces 118 may be above. An advantage of the embodiment as shown in FIG. 8, and similar embodiments, is that it requires fewer parts if a separate set screw is not used.

Figure 9:
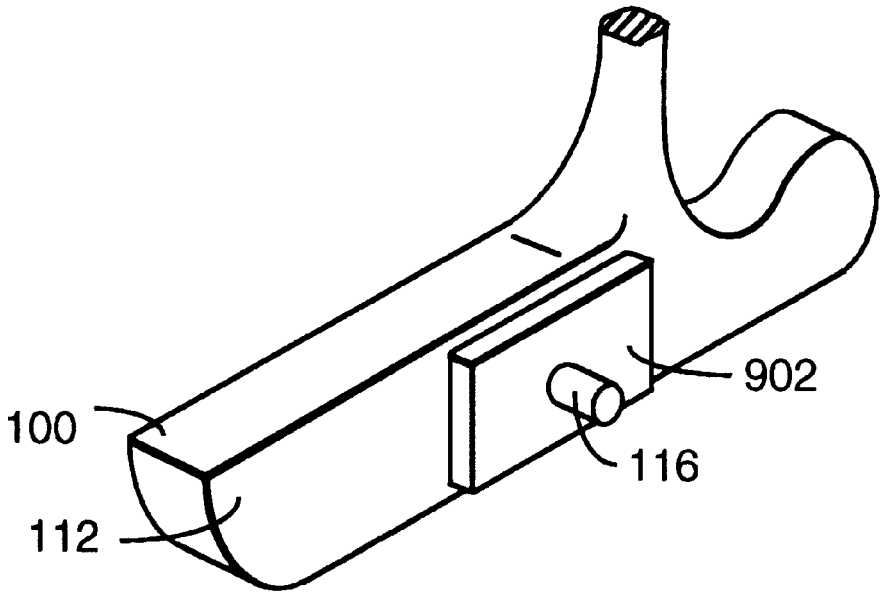
FIG. 9 is a perspective view of a fourth embodiment of the invention.

FIG. 9 is a perspective view showing a fourth embodiment of the invention. As shown, a front bracket 902 is mounted against front face 112 of club head 100 so as to hold striking pin 116 essentially perpendicular to front face 112. Front bracket 902 may be mounted against front face 112 in several ways. In one embodiment, bracket 902 may be attached using a non-permanent adhesive. In some embodiments, front bracket 902 may be attached using one or more magnets if club head 100 is subject to experiencing magnetic force. As discussed above, striking pin 116 may be made removable so that striking pins having different size striking surfaces 118 may be used in accordance with the training method discussed above. An advantage of the embodiment as shown in FIG. 9, and similar embodiments, is that mounting is easily accomplished.

Figure 10:
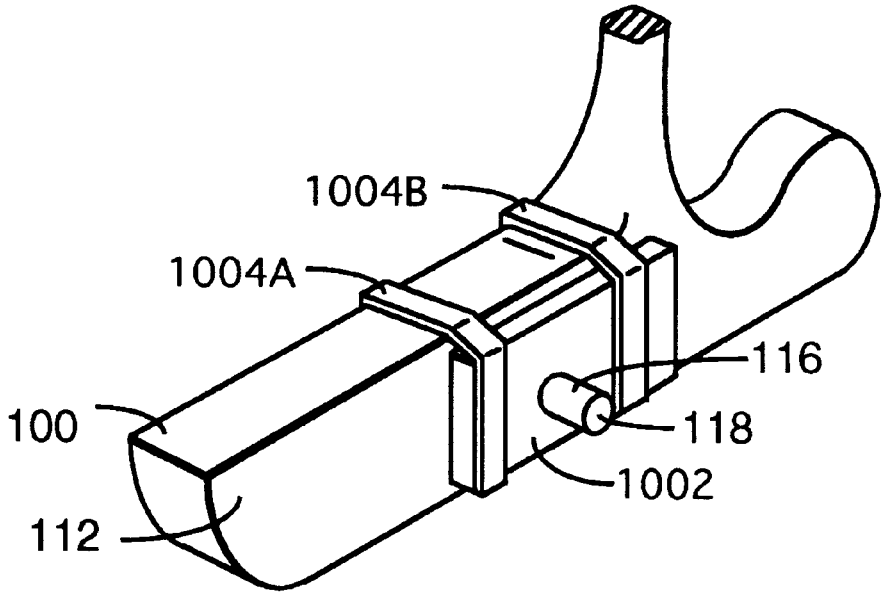
FIG. 10 is a perspective view of a fifth embodiment of the invention.

FIG. 10 is a perspective view of a fifth embodiment of the invention. A flat front bracket 1002 is shown mounted against front face 112 of club head 100 by using flexible bands 1004A and 1004B. Bands 1004A and 1004B may be any conventional rubber band or another elastic device. As discussed above, striking pin 116 may be made removable so that striking pins having different size striking surfaces 118 may be used in accordance with the training method discussed above. An advantage of the embodiment as shown in FIG. 10, and similar embodiments, is that fewer parts are required. For example, the embodiment of the invention will not be inoperative if a set screw is lost.

Those skilled in the art will appreciate that the spirit and scope of the present invention extends beyond the embodiments shown and described above. The following claims encompass the full spirit and scope of the present invention.

I claim:

1. A golf swing training apparatus comprising:

a golf club having a club head;

a bracket having a front portion, a rear portion, and a rigid cross member securing the front portion to the rear portion; and a striking pin having a first and a second end, the first end being securely and removably mounted in the front portion of the bracket, the second end having a flat first striking surface;

wherein the bracket is securely and removably mounted on the golf club head without physically altering the club head, the front portion of the bracket being adjacent a striking face of the club head and the rear portion of the bracket being adjacent a rear surface of the club head, and the striking pin being positioned such that the striking pin extends away from the club head and first striking surface is substantially parallel to the face of the club head.

2. The apparatus of claim 1 wherein the first end of said striking pin is threaded, and a hole in the front portion of the bracket is threaded to receive the first end of said striking pin.

3. The apparatus of claim 2 wherein the first end of said striking pin is configured to have the same diameter and thread pitch as a set screw used to affix said bracket to said golf club head, the set screw being positioned in the rear portion of the bracket so that being tightened against the rear surface of the club head, the screw securely holds the bracket on the club head.

4. The apparatus of claim 1 wherein the club is a putter.

5. The apparatus of claim 1 further comprising a set screw positioned in the rear portion of the bracket so that being tightened against the rear surface of the club head, the screw securely holds the bracket on the club head.

6. The apparatus of claim 5 wherein the set screw is configured to allow finger tightening.

7. The apparatus of claim 1, further comprising a second striking pin having a third end and a forth end, the third end being configured to be securely and removably mounted on the front portion of the bracket, the fourth end having a second flat striking surface, the second striking surface having an area less than an area of the striking surface.

8. A golf swing training apparatus comprising:

a golf club having a club head;

a bracket having a front portion, a rear portion, and means for connecting the front and rear portions, wherein the bracket receives at least a portion of the golf club head between the front and rear portions;

means for securely and removably mounting the bracket on the club head without physically altering the club head;

a striking pin having a first and second end, the second end having a flat first striking surface; and means for securely and removably mounting the first end of the striking pin in the front portion of the bracket such that the striking pin extends away from the club head and the first striking surface is substantially parallel to a striking face of the club head.

9. The apparatus of claim 8 wherein said means for removably mounting the first end of the striking pin comprises screw threads.

10. The apparatus of claim 8 wherein said means for removably mounting the bracket comprises a set screw.

11. The apparatus of claim 10 wherein said set screw is configured to allow finger tightening.

12. The apparatus of claim 8, further comprising:

a second striking pin having a third end and a forth end; and means for securely and removably mounting the third end of the second striking pin in the front portion of the bracket such that the second striking pin extends away from the club head and the second striking surface is substantially parallel to the striking of the club head;

wherein the second striking surface has an area less than an area of the first striking surface.

13. The apparatus of claim 8, wherein the means for securely and removably mounting the bracket on the club head comprises a spring clamp.

* * * * *